US006240250B1

(12) United States Patent
Blanco, Jr.

(10) Patent No.: US 6,240,250 B1
(45) Date of Patent: May 29, 2001

(54) COMPACT IN-LINE TANKLESS DOUBLE ELEMENT WATER HEATER

(76) Inventor: Byron Blanco, Jr., 141 Calle Iglesia, San Clemente, CA (US) 92672

( * ) Notice: Subject to any disclaimer, the term of this patent is extended or adjusted under 35 U.S.C. 154(b) by 0 days.

(21) Appl. No.: 09/655,580

(22) Filed: Sep. 6, 2000

Related U.S. Application Data

(63) Continuation-in-part of application No. 09/329,976, filed on Jun. 10, 1999.

(51) Int. Cl.[7] ..... F24H 1/10

(52) U.S. Cl. ..... 392/490; 392/474; 392/475; 392/485

(58) Field of Search ..... 392/490, 465, 392/474, 475, 476, 485, 487, 488, 489

(56) References Cited

U.S. PATENT DOCUMENTS

| | | | | |
|---|---|---|---|---|
| 1,766,068 | * | 6/1930 | De Lannoy | 392/490 |
| 2,791,671 | * | 5/1957 | Price | 392/474 |
| 2,903,551 | * | 9/1959 | Fischer | 392/474 |
| 3,560,706 | * | 2/1971 | Fonseca | 392/485 |
| 4,514,617 | * | 4/1985 | Amit | 392/485 |
| 4,924,069 | * | 5/1990 | Giordani | 392/485 |
| 5,277,152 | * | 1/1994 | Liao | 392/485 |
| 5,285,717 | * | 2/1994 | Knepler | 392/485 |
| 5,400,432 | * | 3/1995 | Kager et al. | 392/485 |
| 5,408,578 | * | 4/1995 | Bolivar | 392/485 |
| 5,740,315 | * | 4/1998 | Onishi et al. | 392/490 |
| 6,061,499 | * | 5/2000 | Hlebovy | 392/485 |
| 6,080,973 | * | 6/2000 | Thweatt, Jr. | 392/485 |

* cited by examiner

*Primary Examiner*—Teresa Walberg
*Assistant Examiner*—Fadi H. Dahbour
(74) *Attorney, Agent, or Firm*—James G. O'Neill

(57) ABSTRACT

A compact "in-line" tankless double element water heater includes a top connected to a manifold having a cold water inlet and a hot water outlet for connection to the cold, and hot water lines of a faucet. The compact water heater includes a body with a passageway through which cold water travels, from the top towards the bottom, where it is fed into four separate chambers, two each separated on opposed sides of the body and of a diaphragm. A first of the two chambers on each side has no outlet, and the pressure of cold water therein presses against a first side of the respective diaphragm, while the second of the two chambers on each side includes an outlet to a separate hot water chamber on each side, having a separate heating element therein. A second of the two chambers on each side also includes a plunger, biased by a spring against a second side of the diaphragm, and a plunger rod, which contacts an operating member of a microswitch. When the hot water handle of a faucet is opened, water travels from each of the separate hot water chambers to lower the cold water pressure in each of the second chambers and flex each of the diaphragms toward its respective microswitch, to move the abutting operating members and actuate the microswitches so that each of the heating elements is switched on. When the hot water handle is closed, the pressure in each of the two chambers will be equalized, and the springs will force the diaphragms to their starting positions to shut off the two heating elements. A sheet metal stepped plate is held in a fully sealed enclosure and secured to temperature limit switches for added safety and security.

20 Claims, 5 Drawing Sheets

COMPACT IN-LINE TANKLESS DOUBLE ELEMENT WATER HEATER

CROSS-REFERENCE TO RELATED APPLICATION

This application is a continuation-in-part application of pending application Ser. No. 09/329,976, filed Jun. 10, 1999.

BACKGROUND OF THE INVENTION

1. Field of the Invention

This invention relates generally to water heaters, and, more particularly, to an improved "in-line", compact double element electrical resistance water heater.

2. Description of Related Art

Electrical resistance "in-line" water heaters are well known in the art. An example of such a water heater is set forth in U.S. Pat. No. 5,437,003 to Blanco ("'003"). The disclosure of the '003 patent is incorporated herein, in its entirety, by this reference thereto. The Blanco patent discloses a unitary electrical resistance "in-line" tankless water heater, having a body, which is separated into three stacked compartments or sections of circular configuration, and formed of molded, non-conducting plastic material. The lower compartment includes a terminal block for connection to a power supply conduit. An upper compartment encloses a circular heating coil element, and includes a top cover member, having a cold water inlet port and a hot water outlet port. An intermediate compartment encloses a microswitch, which is electrically connected to the power leads via the terminal block in the lower compartment, and to the terminals of the heating coil in the upper compartment. Furthermore, a water flow sensing mechanism is provided within the upper compartment, which, upon sensing water flow between the cold water inlet port and the hot water outlet port, actuates the microswitch within the intermediate compartment to energize the heating coil so as to produce hot water based upon the flow demand therefor.

The in-line tankless hot water heater disclosed and claimed in the '003 patent provides an improvement in the art, which is still useful today. However, the present invention provides an improved in-line tankless water heater of different configuration, having two heating elements contained in separate compartments for improved efficiency, as well as for the increased production of hot water, thereby allowing wider use thereof.

SUMMARY OF THE INVENTION

Accordingly, it is a general object of the present invention to provide an improved "in-line" tankless electrical resistance water heater of compact size. It is a particular object of the present invention to provide an improved continuous flow electrical resistance "in-line" tankless water heater, which can be easily installed and serviced. It is another particular object of the present invention to provide an improved "in-line" tankless electrical resistance water be heater having a pair of heating elements held in separate elongated compartments. It is yet another particular object of the present invention to provide an improved "in-line" tankless electrical resistance water heater for providing large quantities of continuous hot water, and which is instantaneously responsive to the demand for hot water. It is still another particular object of the present invention to provide an improved "in-line" tankless electrical resistance water heater having double water heating elements in separate compartments, in which incoming cold water flows through a dedicated passageway in the water heater body to the bottom of the body where the cold water is diverted to operate separate control devices for actuating the double water heating elements. And, it is a further particular object of the present invention to provide an improved compact "in-line" tankless water heater having a pair of heating elements, which produce sufficient hot water to enable a person to bathe or shower, or for other uses.

These and other objects of the present invention are achieved by providing an improved "in-line" tankless electrical resistance water heater in which cold water enters a top inlet of a body and flows through a dedicated passageway in the body to a bottom of the body. Adjacent the bottom of the body, the cold water flows into four separate chambers, two each on opposite sides of the body. The two chambers on opposed sides of the body are comprised a first chamber having an inlet, but no outlet, to thereby only allow cold water to exert pressure against a resilient diaphragm or element for actuation of a plunger, and a second chamber, adjacent the bottom of the housing having both a cold water inlet and a cold water outlet connected to a separate hot water compartment having one of a pair of heating elements held therein. Each of the second chambers exert a further pressure against an opposite side of their respective resilient diaphragms to force the plungers in an opposite direction. When a hot water faucet connected to an outlet of the water heater is opened, the pair of heating elements are activated to instantly heat the water in its respective compartment. When the hot water faucet is shut off, pressure will act against each diaphragm in a reverse direction, to shut off each of the pair of heating elements.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein like reference numerals are used throughout the several views, and, in which:

DESCRIPTION OF THE PREFERRED EMBODIMENTS

Figure 1:
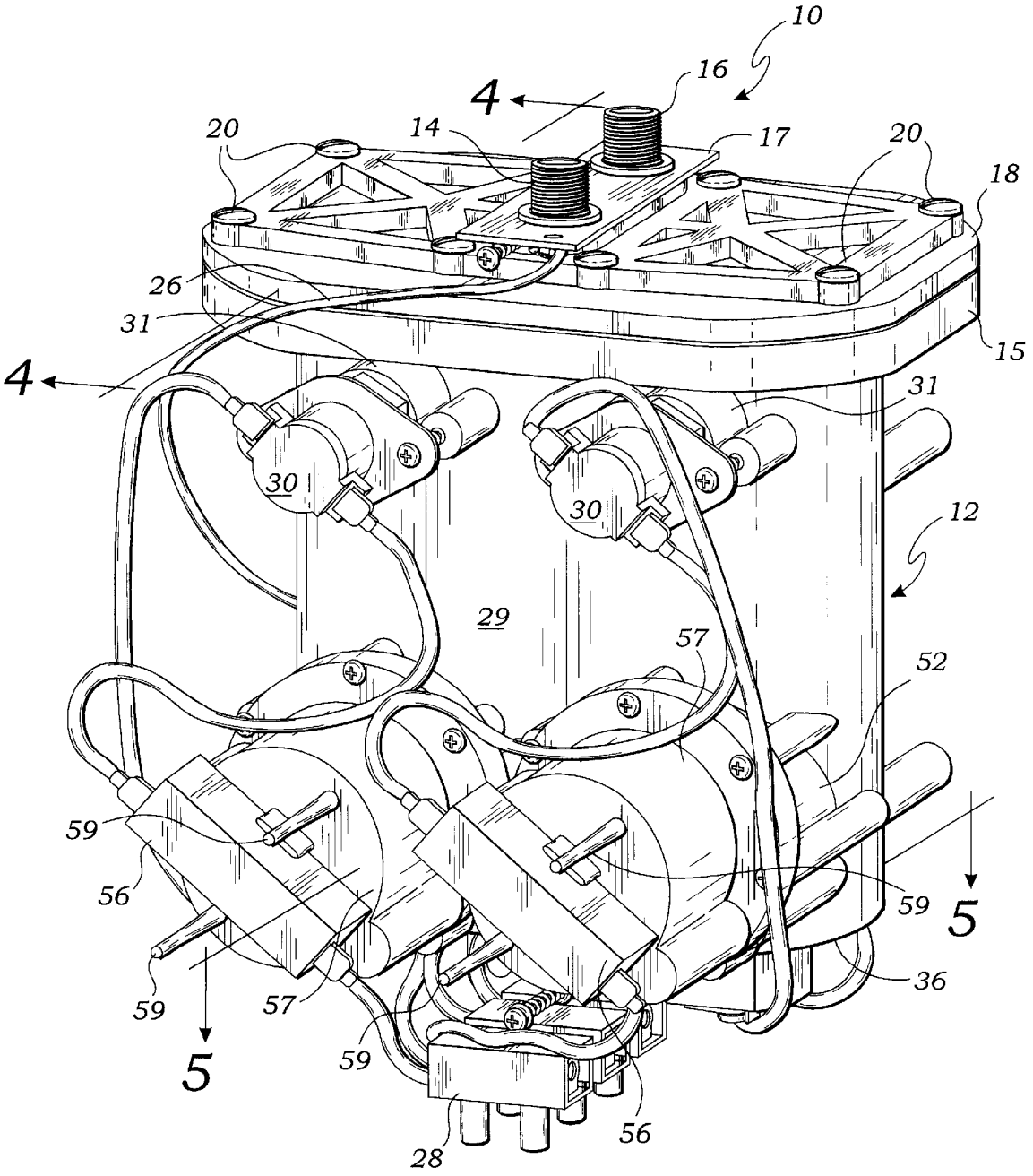
FIG. 1 is a front perspective view of a preferred embodiment of the improved compact "in-line" tankless double element water heater of the present invention.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved compact "in-line" tankless double heating element water heater generally indicated by the numeral 10. This water heater is for interconnection between an electrical power supply, a cold water inlet line and a hot water supply line and made to be mounted on a wall, adjacent a shower, under a sink, or the like.

As shown in the drawings, the improved water heater 10 of the present invention includes a body or housing 12 preferably made from a flame-retardant plastic, such as ZYTEL by Dupont and/or ABS manufactured by G.E. The body 12 may be molded or otherwise fabricated, in any desired size or shape, so as to be a single piece having an enlarged top portion 15, with a manifold 18 secured thereto. A cold water inlet 14, preferably made from a metal, such as brass, and a hot water outlet 16, preferably made from the same material are secured in a holding and ground plate 17 and the manifold 18. The holding and ground plate 17 also provides torque control to the cold water inlet 14 and hot water outlet 16 during installation and removal of the device in a system to supply instant hot water to a faucet or shower. The manifold 18 is releasably secured in place by a plurality of fastening elements 20, such as screws, or the like, captured in holding elements, such as metal inserts, held in openings formed around the top portion 15 of the body 12. The cold water inlet 14, the hot water outlet 16 and the holding plate 17 are grounded, as by means of metallic elements 22, such as screws, or the like, connected to one or more ground wires 26. The ground wire 26 is preferably connected to a backing plate 24 (see FIG. 2), and then to a terminal block 28 mounted on a lower portion of the body 12, preferably at the bottom of the body. A front portion 29 of the body includes releasably mounted on extending portions 31, high-temperature limit switches 30. The high-temperature limit switches 30 are connected to the terminal block 28, and to separate sensing elements 32 (see FIG. 4) extending into separate compartments or water heating spaces 34, 35, formed on opposite sides of the body 12 (see FIG. 5). The pair of limit switches or thermostats 30 provide a double safety feature to the present invention. The thermostats 30 are preferably of the type which will shut off automatically at a pre-set temperature, for example, about 135° F. The thermostats 30 also preferably have a top cut-off temperature, for example, about 150° F. That is, if either or both thermostats 30 reach this cut-off temperature they will be permanently shut-off or disabled. This enables each of the separate compartments or water heating spaces 34, 35 to act independently, if the other is incapacitated, as described more fully below.

Figure 4:
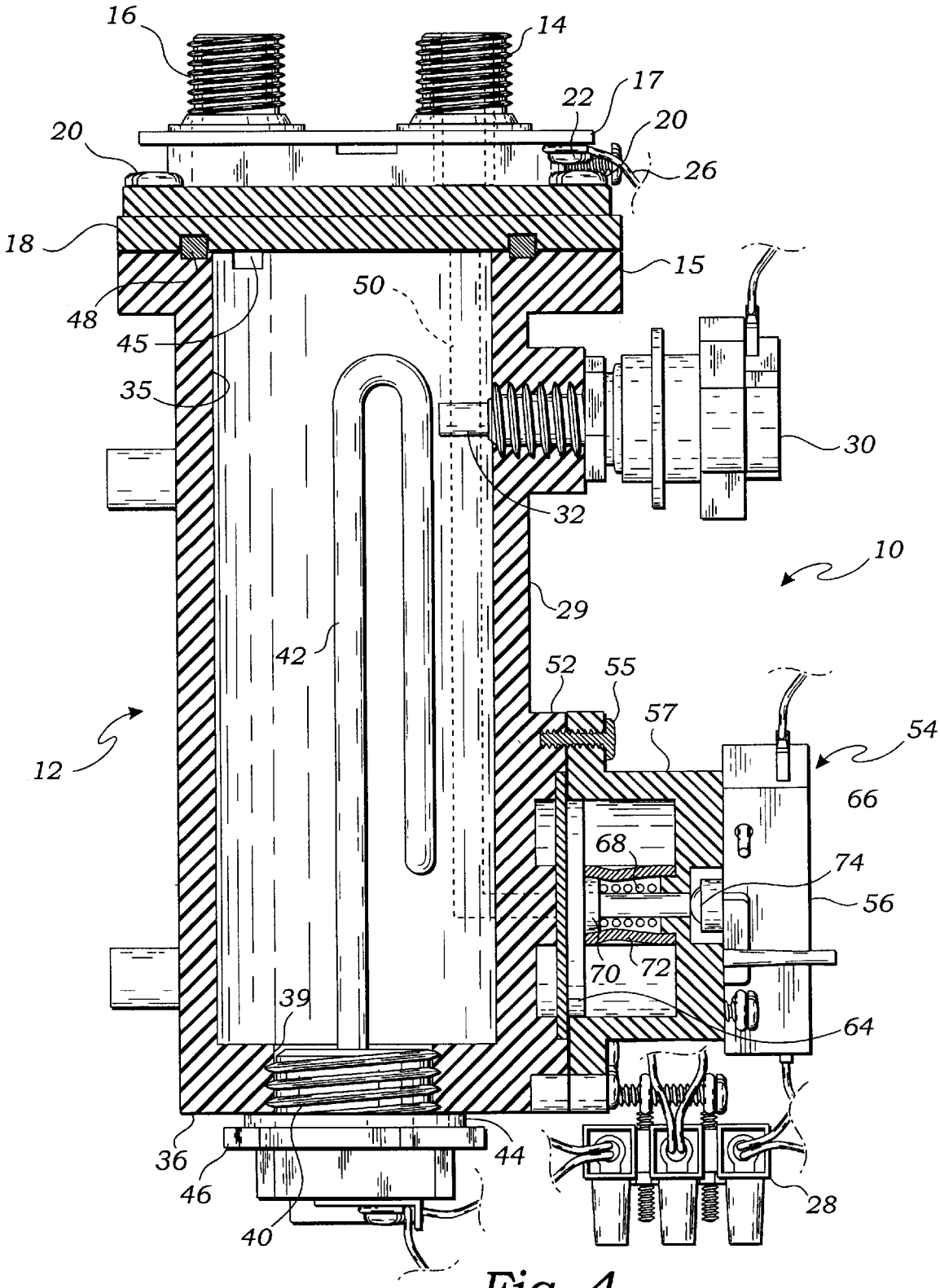
FIG. 4 is a cross-sectional view taken along line 4—4 of FIG. 1.

A lower end or wall 36 of the body 12 preferably closes off the lower portion of body 12, except for openings 39 formed therein. The openings 39 are preferably threaded, and capture threaded ends 40 of heating elements 42. A sealing gasket or O-ring 44 is held between a raised lip 46 of each of the threaded ends 40 and the end wall 36 of the body 12, to prevent water leakage. As shown in FIG. 4, the top 15 of the body 12 also includes a sealing element 48, such as a gasket, O-ring, or the like, which may be held in annular grooves formed in the manifold 18, and the top 15, to prevent water leakage.

Figure 5:
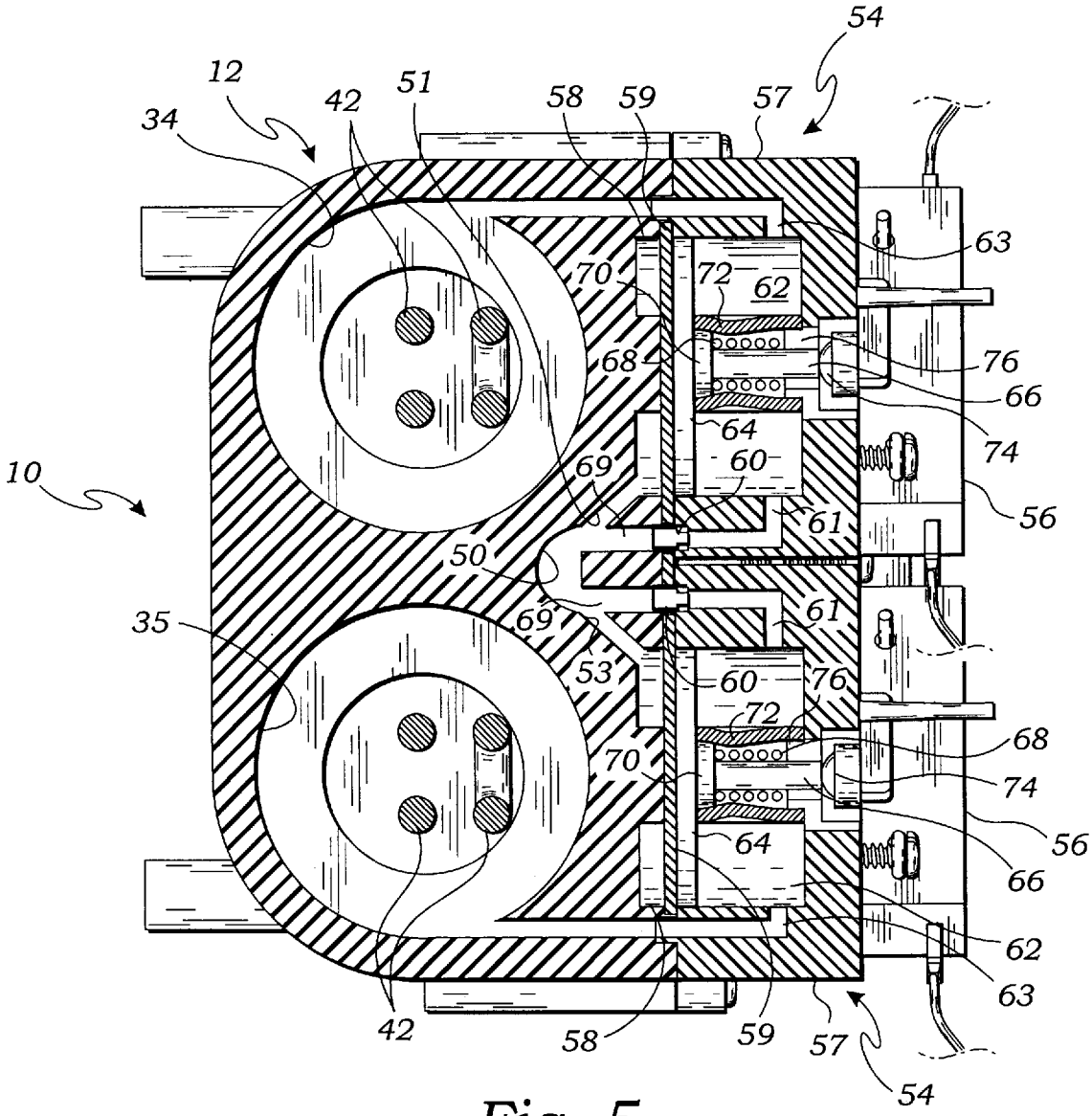
FIG. 5 is a cross-sectional view taken along line 5—5 of FIG. 1.

Cold water entering the cold water inlet 14 flows through a dedicated water passageway 50 formed in the body 12, as shown in broken line in FIG. 4 and solid line in FIG. 5, adjacent the front 29 of the body 12. As shown in FIGS. 4 and 5, the water passageway 50 branches toward the lower end 36 of the body 12 so as to form angled passageways 51, 53. The angled passageways 51, 53 are connected to further elevated or raised portions 52 formed on the front of the body 12. A means for sensing flow of cold water, and for actuating the heating elements 42, generally identified as 54, is releasably mounted on each raised portion 52, by means of a plurality of securing elements 55, such as screws, or the like. Each of the means for sensing flow and actuating the heating elements 54 includes a microswitch 56, held on a top cap 57. The top caps 57 are secured to each of the raised portions 52, and are preferably made from a CPVC plastic manufactured by B.F. Goodrich. Each of the top caps 57 includes a pair of spaced-apart arms 59 extending from a top surface and the microswitches 56 are nested or held between the pairs of arms.

Figure 2:
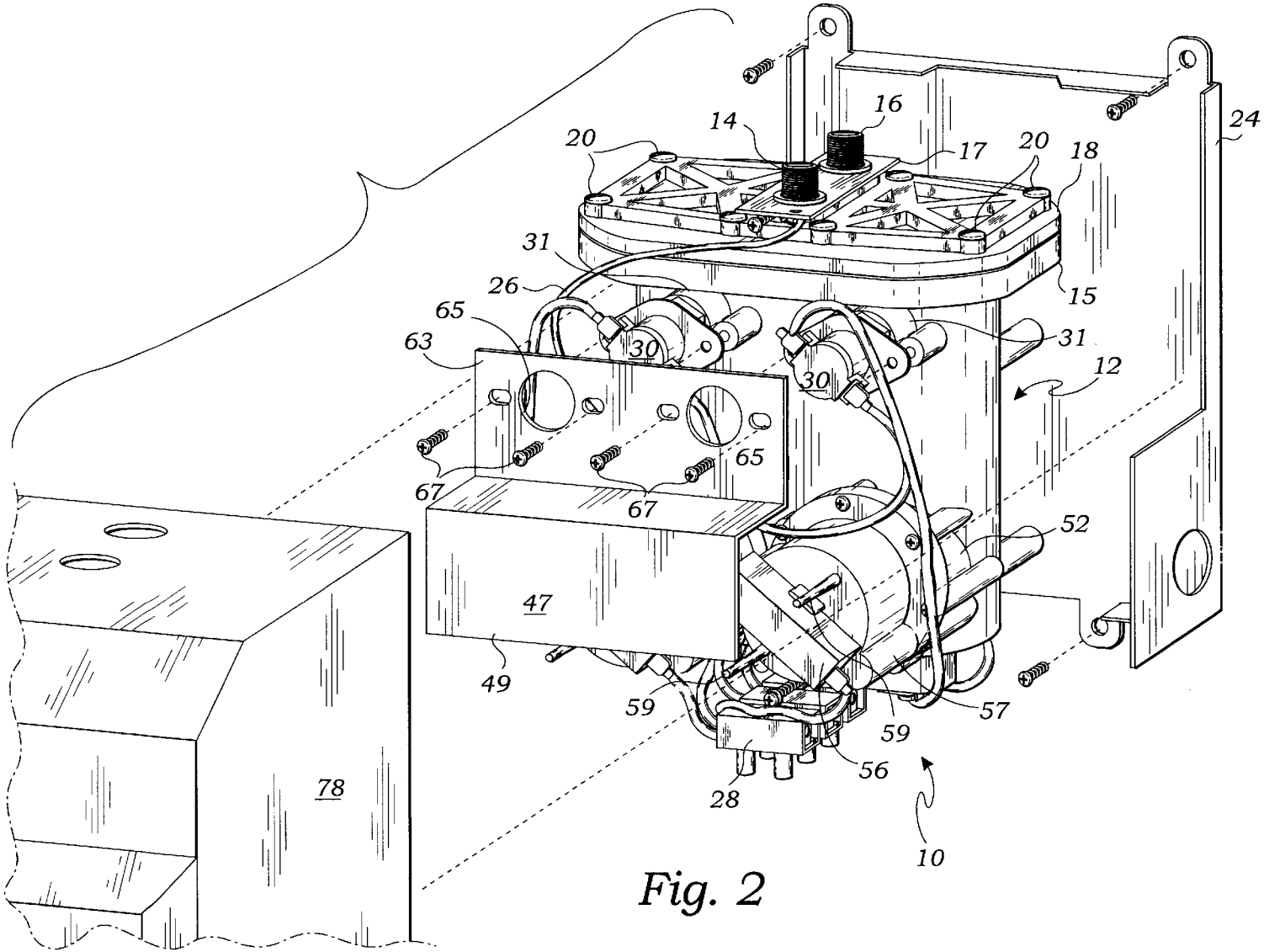
FIG. 2 is an exploded perspective view of the water heater of FIG. 1, a heat deflecting plate and a partial exterior housing.

The arms 59 on each of the caps 57 engage a bottom surface of a first step 49 of a stepped sheet metal plate 47, preferably made from aluminum and about 0.015 inches thick (see FIG. 2). The stepped sheet metal plate 47 includes a second, flat stepped portion 63 having openings 65 formed therein. These openings 65 are mounted over the raised portions 31, and the temperature limit switches 30 are mounted over the first stepped portion 63, through the openings 65. The limit switches 30 and the stepped sheet metal plate 47 are then secured in place by a plurality of securing elements 67, for example, screws, or the like. The ends of the arms 59 engage the bottom surface of the first step 49 to prevent the bottom surface from touching the microswitches 56.

The wires shown connected to the limit switch 30, the end of each heating element 42, and the microswitches 56 are all connected to the terminal block 28, in a known manner. Additionally, power is brought to the terminal block, in a known manner, via a power cord (not shown), which is connected to an outlet.

The operation of the device of the present invention, including the flow sensing/heat activating means 54 will now be described. As previously explained, cold water from a cold water line attached to inlet 14 will enter cold water inlet 14, flow through internal passageway 50, and then, as shown in FIG. 5, through angled passageways 51, 53. The cold water then enters a pair of first chambers 58, having no outlet, on one side of resilient elements or diaphragms 59, secured between each raised portion 52 of body 12 and the top caps 57. The cold water also flows through a pair of passageways 69, having flow restrictors 60 therein. The flow restrictors are formed from stainless steel, or the like, and are reduced-diameter elements, held in a pair of further passageways 61, which are connected to further or second chambers 62. Chambers 62 include outlet passageways 63, connected to the holding chambers 34, 35 at the bottom. Disks 64 are reciprocally mounted within each second chamber 62, and held against an upper or second surface of each diaphragm 59, as by means of elongated plunger rods 66, having enlarged heads 70 secured to or held against the disks. A spring 68 is held around each elongated plunger rod 66 between enlarged heads 70, and further annular portions 76 formed in each chamber 62. Flexible sealing tubes 72 are mounted within each chamber 62 so that they seal the enlarged heads 70 and the annular portions 76 against water. A free or upper end of each plunger rod 66 contacts a plunger switch 74 of each microswitch 56, to activate each microswitch upon water flow within the device, as explained more fully below.

As explained above, the diaphragms 59 separate each set of two chambers 58 and 62. The diaphragms 59 are preferably made of silicon, or some other type of resilient material, such as rubber, or the like.

The water heater 10 of the present invention is connected, for example, under a sink, or adjacent a shower, between the hot and cold water lines of a water faucet. After connection, when a hot water handle or tap is actuated or operated, water flows from each chamber 34, 35, through an exit passageway 45 between the chambers 34, 35 through the manifold 18 and out the hot water outlet 16. The flow of water from each chamber 34, 35, will lower the pressure in each chamber 62 whereby pressure of the cold water in each chamber 58 will be higher, thereby moving its respective diaphragm 59 outwardly, against the action of the spring 68. The higher pressure in chamber 58 occurs because of the flow restrictors 60 in passageways 69. That is, the water pressure in each first chamber 58 will be higher than that in each second chamber 62, so that each diaphragm 59 and its mating disk 64 will move against the bias of its biasing spring 68, toward the microswitches 56. This movement brings the upper end of each plunger rod 66 into contact with each plunger switch 74 to activate each microswitch 56. Upon activation of each microswitch 56, each heating element 42 will be activated to substantially instantly heat the water in chambers 34 and 35. Once the open hot water tap is closed, hot water will no longer exit the chambers 34, 35 through outlet 16, and the pressure in each chamber 62 will rise to eventually equal that of the pressure in each chamber 58. Each spring 68 will bias its respective disk 64 against its diaphragm 59, to move each plunger rod 66 downwardly, to thereby open or release each plunger switch 74 and cut-off power to each heating element 42. It is understood that each spring 68 must be sized and dimensioned so that the force thereof allows the disks 64 and plunger rods 66 to activate the switches 74 upon hot water exiting from each chamber 34, 35, through the water outlet 16. However, the springs 68 must be of sufficient force to return the disks 64 and plunger rods 66, to their closed positions, when the hot water tap connected to outlet 16 is closed.

Figure 3:
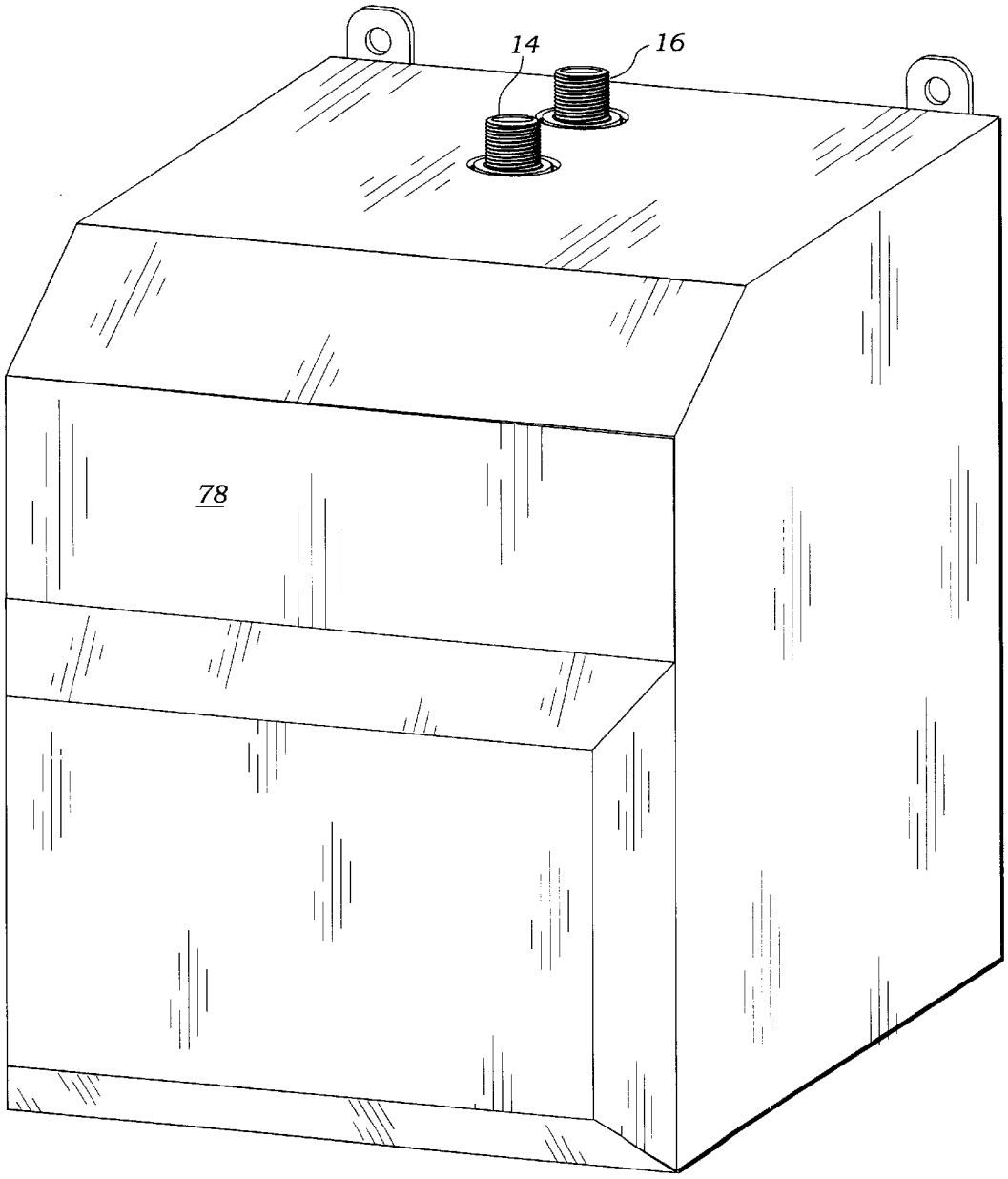
FIG. 3 is a perspective view of an exterior housing having the water heater of the present invention therein.

It is to be understood that the body 12 of the water heater of the present invention is sized and dimensioned so that it may be easily handled and mounted in a vertical position against a wall via a mounting plate, such as 24, under a sink, adjacent a shower, or in any other convenient position. The water heater works best with the inlet 14 and outlet 16 in the vertical positions shown in FIGS. 1–4. Furthermore, it is to be understood, that an exterior protective and/or decorative cover or housing 78 (see FIGS. 2 and 3) should be placed over the water heater 10 of the present invention so as to cover and protect the limit switches 30, the terminal block 28 and the microswitches 56. The housing 78 also needs an opening (not shown) to allow a power supply to be inserted therein and connected to the terminal block 28, so as to power the water heater 10. With the cover 78 in place, and the sheet metal stepped plate 47 secured in place, any excess heat within the cover 78, for example, one caused by a short circuit, fire, or the like, will be transmitted to the thermostats or limit switches 30, so as to deactivate or disconnect the heating elements 42 for added safety and security.

It, therefore, can be seen that the present invention provides an improved tankless water heater, which delivers instant hot water from two, separate chambers, upon actuation of a hot water faucet to which the heater is connected. The device includes a pair of separate combination flow sensing and heat element-activating portions connected to and controlled by the flow of cold water entering and exiting a pair of chambers in each activating portion.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. An improved "in-line" tankless water heater for interconnection between an electrical power supply, a cold water inlet line and a hot water supply line; the water heater, comprising:

an elongated body having a top and a bottom;

a pair of temperature limit switches, a terminal block and a pair of microswitches mounted on an exterior surface of the elongated body;

each of the pair of microswitches being carried on a lower portion of the elongated body, over a pair of chambers, secured to the elongated body;

a cold water inlet and a hot water outlet held in the top of the elongated body;

an elongated passage formed internally of the elongated body in fluid communication between the cold water inlet and each of the pair of chambers;

each of the pair of chambers being separated by a resilient element;

a first chamber of each of the pair of chambers having an inlet and no outlet;

a second chamber of each of the pair of chambers having an inlet and an outlet;

a pair of heating elements held in a pair of elongated water heating chambers formed in the elongated body;

each of the pair of elongated water heating chambers being in fluid communication with the outlet of the second chamber of each of the pair of chambers and the hot water outlet; and means for actuating the pair of microswitches to activate the pair of heating elements and heat the water in the pair of elongated water heating chambers.

2. The "in-line" tankless water heater of claim 1 wherein the means for actuating the pair of microswitches is responsive to flow of cold water from the second chamber of each of the pair of chambers, upon opening of a tap in the hot water line.

3. The "in-line" tankless water heater of claim 2, further including flow restrictors between the first chamber of each of the pair of chambers and the second chamber of each of the pair of chambers; and wherein the flow of cold water into the first chamber of each of the pair of chambers acts against a first side of the resilient element in each of the pair of chambers to move the resilient element in each of the pair of chambers toward each of the microswitches when the cold water in the second chamber of each of the pair of chambers flows into each of the pair of elongated water heating chambers, upon flow of water from each of the pair of elongated water heating chambers to through the hot water outlet.

4. The "in-line" tankless water heater of claim 3, further including a reciprocating disk member having a plunger rod held in the second chamber of each of the pair of chambers, with each disk member held against a second side of the resilient element in each of the pair of chambers.

5. The "in-line" tankless water heater of claim 3, further including a biasing element, mounted on each plunger rod, between an operating member of each of the microswitches and each reciprocating disk member; each biasing element normally holding each reciprocating disk member against the resilient element in each of the pair of chambers, and the resilient element in each of the pair of chambers in a rest position.

6. The "in-line" tankless water heater of claim 5 wherein the pair of heating elements are elongated members held in the bottom of the elongated body so as to extend into the pair of elongated water-heating chambers, and the cold water inlet and the hot water outlet are held in a manifold connected to the top of the elongated body.

7. The "in-line" tankless water heater of claim 1 wherein the means for actuating the pair of microswitches is responsive to the flow of cold water from the second chamber of each of the pair of chambers, upon opening of the hot water supply line and comprises a diaphragm held between and separating the first chamber of each of the pair of chambers and the second chamber of each of the pair of chambers, and a plunger actuator in the second chamber of each of the pair of chambers, for actuating a plunger switch connected to each of the pair of microswitches.

8. The "in-line" tankless water heater of claim 7, further including a reciprocating disk member attached to a plunger rod held in the second chamber of each of the pair of chambers, with each disk member held against each diaphragm.

9. The "in-line" tankless water heater of claim 8, further including a spring mounted on each plunger rod between each plunger switch and each disk member; each spring normally biasing each disk member against each diaphragm.

10. The "in-line" tankless water heater of claim 9 wherein the pair of heating elements are elongated members held in openings formed in the bottom of the elongated body so as to extend into the pair of elongated water-heating chambers; and the cold water inlet and the hot water outlet are held in a manifold connected to the top of the elongated body, with a holding plate held between the cold water inlet and the hot water outlet.

11. An improved "in-line" tankless water heater for interconnection between an electrical power supply, a cold water inlet line and a hot water supply line; the water heater, comprising:

an elongated body having a top and a bottom;

a manifold connected to the top, the manifold having a cold water inlet and a hot water outlet attached to the manifold;

a holding plate secured between the cold water inlet and the hot water outlet;

a pair of temperature limit switches, a terminal block and a pair of microswitches mounted on an exterior surface of the elongated body, between the top and the bottom;

the pair of microswitches being carried on a lower portion of the elongated body, over first and second chambers, and being secured to the elongated body;

an elongated passage formed internally of the elongated body and in fluid communication between the cold water inlet and each of the first and second chambers;

each of the first and the second chambers being separated by a resilient element;

each first chamber having an inlet and no outlet;

each second chamber having an inlet and an outlet;

a pair of heating elements held in a pair of elongated water heating chambers formed in the elongated body, on adjacent sides of the elongated passage;

each of the pair of elongated water heating chambers being in fluid communication with the outlet of one of the second chambers and the hot water outlet; and movable plungers contacting the microswitches to activate the pair of heating elements and heat the water in the pair of elongated water heating chambers, upon movement of each resilient element.

12. The "in-line" tankless water heater of claim 11 wherein the movable plungers include plunger rods and lower disks, and wherein the lower disks and the plunger rods move in response to flow of cold water from each second chamber upon opening of a tap in the hot water line.

13. The "in-line" tankless water heater of claim 12 wherein the resilient element is a diaphragm held between and separating the first and second chambers, and the lower plunger disks rest against a first side of the diaphragm and the plunger rods; and wherein the plunger rods are in the second chambers and actuate plunger switches connected to the microswitches, upon movement of each diaphragm.

14. The "in-line" tankless water heater of claim 13, further including springs held over the plunger rods and an annular element in each second chamber; and the springs bias the plunger disks against the first side of each diaphragm.

15. The "in-line" tankless water heater of claim 14 wherein the plunger rods actuate plunger switches on the microswitches to operate the pair of heating elements.

16. The "in-line" tankless water heater of claim 15 wherein the pair of heating elements are elongated members held in openings in the bottom of the elongated body so as to extend into the pair of elongated water-heating chambers.

17. An improved "in-line" tankless water heater for interconnection between an electrical power supply, a cold water inlet line and a hot water supply line; the water heater, comprising:

an elongated body having a top and a bottom;

a manifold releasably secured to the top and having a cold water inlet and a hot water outlet secured in the manifold;

a combination grounding and holding plate secured between the cold water inlet and the hot water outlet;

a pair of temperature limit switches, a terminal block and a pair of microswitches mounted on an exterior surface of the elongated body, between the top and the bottom;

the pair of microswitches being carried on extending portions formed on a lower portion of the elongated body, over a pair of first chambers and a pair of second chambers;

an elongated passage formed internally of the elongated body and in fluid communication between the cold water inlet and the pair of first and second chambers;

each of the pair of first chambers and second chambers being separated by a diaphragm;

each first chamber having an inlet and no outlet;

each second chamber having an inlet and an outlet;

a pair of elongated heating elements held in a pair of elongated water heating chambers formed in the elongated body, on adjacent sides of the elongated passage;

each of the pair of elongated water heating chambers being in fluid communication with the outlet of one of the pair of second chambers and the hot water outlet; and movable plungers held against first sides of each diaphragm for actuating the pair of microswitches to activate the pair of heating elements and heat the water in the pair of elongated water heating chambers, in response to flow of cold water from each of the pair of second chambers, upon opening of a tap in the hot water line.

18. The "in-line" tankless water heater of claim 17 wherein each of the pair of movable plungers includes a reciprocating disk member attached to a plunger rod held in each of the pair of second chambers, with each disk member held against a first side of each diaphragm.

19. The "in-line" tankless water heater of claim 18, further including a biasing element, mounted on the plunger rod, between an operating member for each of the pair of microswitches and the reciprocating disk member; the biasing element holding the reciprocating disk member against the diaphragm.

20. The "in-line" tankless water heater of claim 19 wherein the pair of heating elements are elongated members held in openings formed in the bottom of the elongated body so as to extend into the pair of elongated water-heating chambers.

* * * * *